US006887070B1

(12) United States Patent
Chellappan et al.

(10) Patent No.: US 6,887,070 B1
(45) Date of Patent: May 3, 2005

(54) FIRED FURNACE OPERATION AND APPARATUS

(75) Inventors: Sellamuthu G. Chellappan, Houston, TX (US); William J. Walker, Baytown, TX (US); David L. Ramsey, Channelview, TX (US)

(73) Assignee: Equistar Chemicals, LP, Houston, TX (US)

( * ) Notice: Subject to any disclaimer, the term of this patent is extended or adjusted under 35 U.S.C. 154(b) by 0 days.

(21) Appl. No.: 10/789,329

(22) Filed: Feb. 27, 2004

(51) Int. Cl.[7] ..... F23N 1/00

(52) U.S. Cl. ..... 431/12; 431/18; 431/89; 126/109; 126/112; 432/29; 432/209; 432/219

(58) Field of Search ..... 431/2, 12, 10, 431/89, 18, 180, 190, 354; 126/116 R, 110 R, 126/112, 109, 99 R; 122/6 R, 7 R, 9; 432/28–30, 432/197, 209, 223; 110/341, 348, 186, 191

(56) References Cited

U.S. PATENT DOCUMENTS

| | | | | |
|---|---|---|---|---|
| 3,894,832 | A * | 7/1975 | Chin et al. | 431/12 |
| 4,260,363 | A * | 4/1981 | Cratin, Jr. | 431/76 |
| 4,261,508 | A * | 4/1981 | Broach | 236/15 BD |
| 4,784,069 | A * | 11/1988 | Stark | 110/211 |
| 5,477,846 | A * | 12/1995 | Cameron | 126/109 |

* cited by examiner

*Primary Examiner*—James C. Young
(74) *Attorney, Agent, or Firm*—Roderick W. MacDonald

(57) ABSTRACT

A method and apparatus for continuing the operation of a fuel fired furnace when the air supply from the blower to the furnace is interrupted by employing a combination of a ventilator and drop door, the ventilator having a power source independent of the blower.

11 Claims, 4 Drawing Sheets

FIRED FURNACE OPERATION AND APPARATUS

BACKGROUND OF THE INVENTION

1. Field of the Invention

This invention relates to fired heater operation, particularly fuel fired furnaces.

2. Description of the Prior Art

Fuel fired furnaces are in general any process heater (burner), boiler, steam super heater, and the like. This invention is applicable to all such apparatus (devices), but, for the sake of clarity and brevity, will be described here in terms of a commercial, hydrocarbon processing plant, and the type of furnace normally employed in such a plant, e.g., a refinery or olefin plant.

A furnace normally is powered by a combustible fuel such as natural gas. As such, the furnace requires an ample supply of combustion oxygen which is usually supplied in the form of ambient air that is forced into the heater section of the furnace. The heater section contains, in simplest form, one or more burners, usually four, which pick up combustion air from an air plenum. Ambient air is supplied to the plenum by a very large blower that forces air through an air duct into the plenum. The burners pick up the combustion air needed, mix the air with the fuel and combust the mixture at the burner tip.

If the burners stop combustion or the blower stops operating, the entire furnace is shut down, and, possibly, the whole plant is shut down. Furnace shutdown has a number of consequences and ramifications.

There are a number of operating aspects for a furnace. First of all is start up (warm up). It can take a very long time to get a furnace and its vent stack up to normal operating temperatures. It is desirable to achieve warm up as quickly as possible, and to avoid shutdowns that would require start up all over again. If a furnace is shut down, it is desirable to be able to achieve start up again as quickly as possible and in as short a time as possible. This means not letting the furnace cool down any more than absolutely necessary.

Next is normal operation. After start up, it is desirable to keep the furnace operating at all times to maintain plant production at least at some, if not peak, producing capacity. Avoiding complete furnace shutdown and cool off is highly desirable, even when a major piece of the furnace such as the air blower becomes inoperable for any reason such as loss of power or mechanical failure.

Safety is always a consideration in furnace operation. There are well-known safety concerns involved in shutting down and restarting a furnace that are not present in the normal operation of the furnace. Accordingly, from a safety aspect it is better to keep the furnace running, even at reduced capacity, than to shut it down and then restart it after it has cooled down.

There is also the possibility of an emergency such as the air blower (either the forced draft or the induced draft blower) losing its power source which then causes the burners to shut down. If the furnace can be kept operating, even at reduced capacity, during an emergency this avoids complete cool off and restart of the furnace thus avoiding some safety considerations and a long warm up period on restart.

Finally, during shutdown for maintenance work on the blower, it is desirable to keep the furnace in operation, thereby maintaining plant production and avoiding furnace cooling and restarting.

This invention addresses all these considerations in that it provides for the continued operation of a furnace at a reduced, but acceptable level of production capacity, thereby avoiding the complete cooling of the furnace and the need for a full start up cycle. With this invention normal operation at some significant level, e.g., at least 66% of normal production capacity can be maintained, but if shutdown does become necessary, this invention can help achieve a quicker start up. By avoiding at least some shutdowns, this invention helps minimize safety considerations brought on by restarting a cold furnace. This invention also helps minimize complete furnace shutdown and start up delays in certain emergencies such as blower failure.

SUMMARY OF THE INVENTION

In accordance with this invention, there is provided apparatus and a method of using that apparatus which accomplishes the foregoing considerations.

The apparatus of this invention involves the employment of a normally closed air ventilator in combination with a drop door in the air duct that extends between the furnace air blower and the plenum, the ventilator being operated and powered independently of the furnace air blower.

The method of this invention involves the operation of the ventilator in combination with the drop door and independently of the furnace air blower.

DETAILED DESCRIPTION OF THE INVENTION

Figure 1:
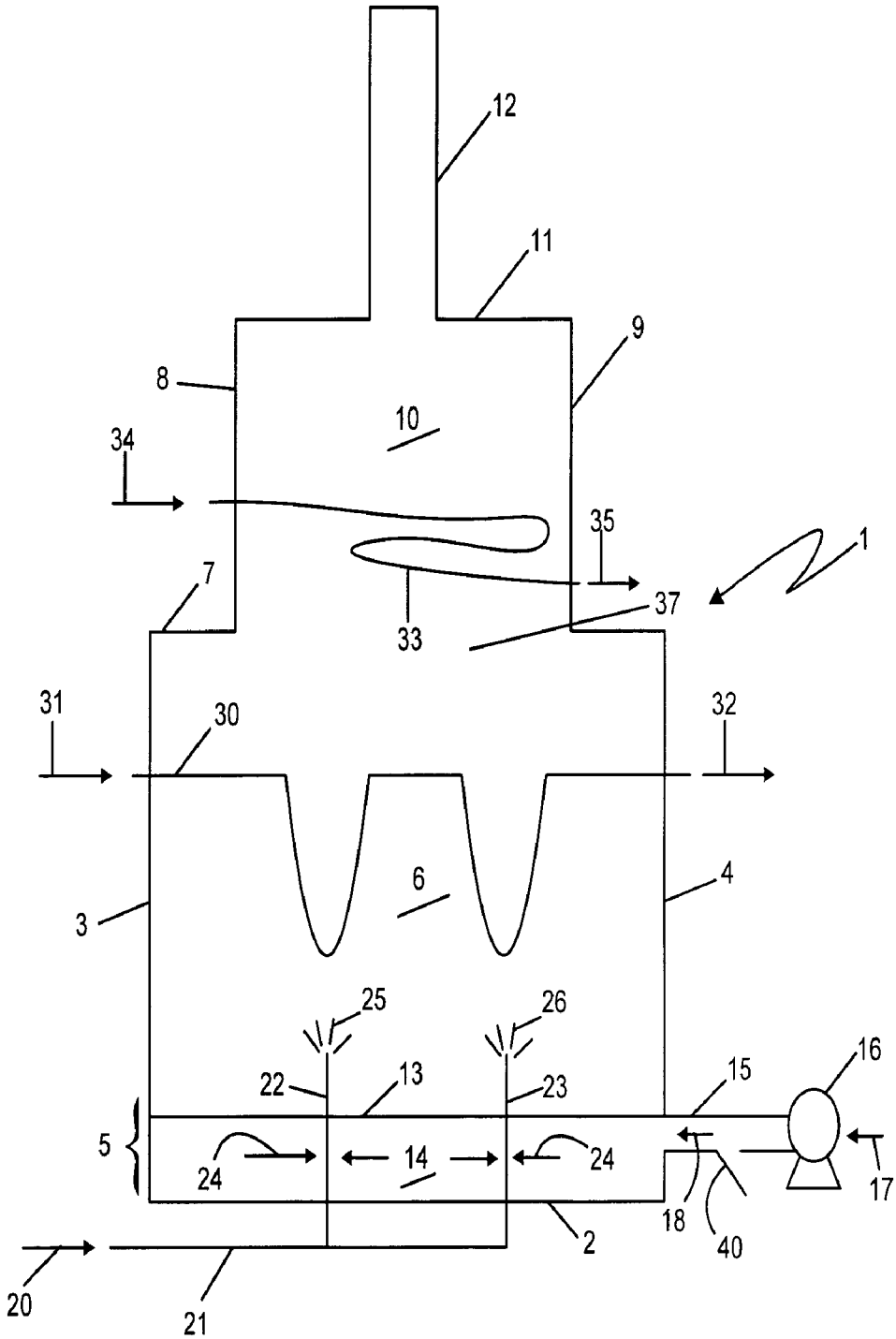
Figure 1 Prior Art
FIG. 1 shows a conventional furnace in which this invention can be employed.

FIG. 1 shows a conventional furnace or steam super heater 1 having a bottom 2 and upstanding sides 3 and 4 which define and enclose the heater section 5 and radiant section 6 of furnace 1. Upper end (top) 7 of section 6 closes hollow section 6, and carries upstanding sides 8 and 9 which define and enclose convection section 10. Surmounted on enclosing top 11 of section 10 is upstanding furnace stack 12. Stack 12 can be quite tall, e.g., hundreds of feet, and can contain a damper or other flow restricting means (not shown).

In heater section 5 between horizontally extending wall 13 and bottom 2 is air plenum 14. Air duct 15 is operably connected between the interior of plenum 14 and the discharge (outlet) duct (not shown) of air blower 16 so that combustion air 17, normally ambient air, can be forced through duct 15 as shown by arrow 18 into the interior of plenum 14 for pick up by burners 22 and 23.

Combustion fuel 20 passes through manifold 21 to a series of burners 22 and 23. Combustion air 24 in plenum 14 mixes with the fuel in known manner in burners 22 and 23 and is then combusted at burner tips 25 and 26 to create radiant heat in the open interior of chamber 6. A coil 30 can, for example, carry steam 31 through chamber 6 to be heated within that chamber, the super heated steam exiting at 32. A water boiler feed coil 33 can carry liquid water 34 to be heated in the closed interior of chamber 10 and exit same at 35.

For example, furnace 1 can be operated on a natural gas fuel 20 with ambient air thereby heating radiant section 6 to from about 1,500F. to 2,000F. Steam 31 enters section 6 at a temperature of about 550F. and 1,500 psig, and exits at 35 at about 900F. The lower portion 37 of convection section 10 is about 1,800F. and the temperature gets gradually cooler as it progresses upwardly in section 10 into stack 12. Liquid water 34 enters section 10 at 350F. and 2,000 psig, and exits at 35 at 500F.

A furnace such as furnace 1 of FIG. 1 has multiple modes of operation in relation to its intake of combustion air 18. In the natural draft mode blower 16 is not operated, and the height of stack 12 causes a natural pull of ambient air 18 into plenum 14 to feed burners 22 and 23. In the forced draft mode, air is forced by blower 16 into plenum 14. With a balanced draft mode, air is forced into plenum 14, and at the same time air is pulled through the furnace by operation of a fan (not shown) located in stack 12. In the induced draft mode, a fan (not shown) in stack 12 pulls air through the furnace by way of duct 15 and plenum 14 with no forced air into plenum 14 by way of blower 16.

This invention is useful in all modes aforesaid as well as applicable to all aspects of furnace operation aforesaid, i.e., start up, normal operation, safety, and emergency.

For example, if furnace 1 is operating in natural draft mode, this invention provides quicker start up. In the forced draft mode this invention provides not only quicker start up, but also improved safety by keeping the furnace operating even if blower 16 becomes inoperable. Further, this invention can help restart a furnace sooner and with shorter warm up time thereby avoiding furnace cooling for an extended or otherwise undue amount of time.

Figure 2:
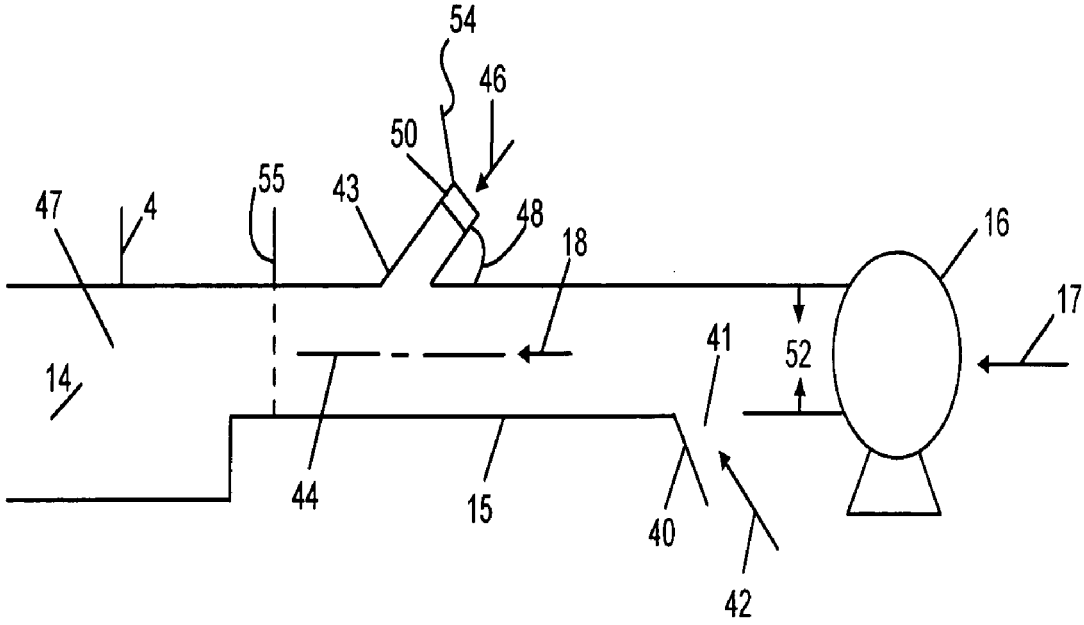
FIG. 2 shows one embodiment within this invention.

One embodiment within this invention is shown in FIG. 2. In FIG. 2 blower 16 is operably connected to the open interior of duct 15 which in turn is operably connected to the open interior of plenum 14 so that air can flow from blower 16 through duct 15 to heating section 5 of furnace 1. In the prior art, duct 15 normally carries a drop down door 40. Although normally, in a closed position (shut) when furnace 1 is in normal operation mode, door 40 is shown in FIG. 2 to be open for sake of clarity. The opening 41 created in duct 15 when door 40 is open allows ambient air 42 to enter the interior of duct 15.

In the prior art, door 40 was opened, automatically or manually, when blower 16 became inoperable (tripped) to allow the furnace to go into natural draft mode in the hopes it would keep the furnace operating at a reasonable level. It has been found with actual experience that the efficiency, i.e., production capacity of the furnace, was reduced by at least 50% with the drop door only approach. The use of a portable fan in opening 41 did not increase the efficiency appreciably, less than 10%. Thus, the use of door 40, with or without fan assist at door opening 41, was found by actual experience not to maintain furnace operation at an acceptably elevated level of producing capacity.

To keep all burners operating at all times, even without blower 16, to maintain an acceptable operating efficiency for the furnace to maintain plant efficiency, and to minimize safety concerns relative to furnace shutdown and start up, in accordance with this invention, a duct 43 was installed in duct 15 downstream of blower 16 and door 40 but upstream of plenum 14. Duct 43 can be perpendicular to long axis 44 of duct 15 which axis extends between the air discharge outlet 52 of blower 16 and air inlet 47 of plenum 14. Alternatively, as shown in FIG. 2, duct 43 can be oriented to be at an angle 48 to long axis 44 which angle disposes duct 43 so as to direct ambient air 46 that enters duct 15 by way of duct 43 towards plenum inlet 47. Duct 43 carries a ventilator (air mover) 50 which forces ambient air 46 into duct 15 by way of duct 43, and then towards plenum 14. Duct 43 should not be angled so as to direct air toward blower 16.

Ventilator 50 is not just a replacement blower 16. Its cost is a fraction, less than one-sixth, of the cost of blower 16. It is a tank ventilator operated in reverse in that instead of ventilating vapor it moves air into duct 43 at a significantly lower volume than a blower.

Figure 3:
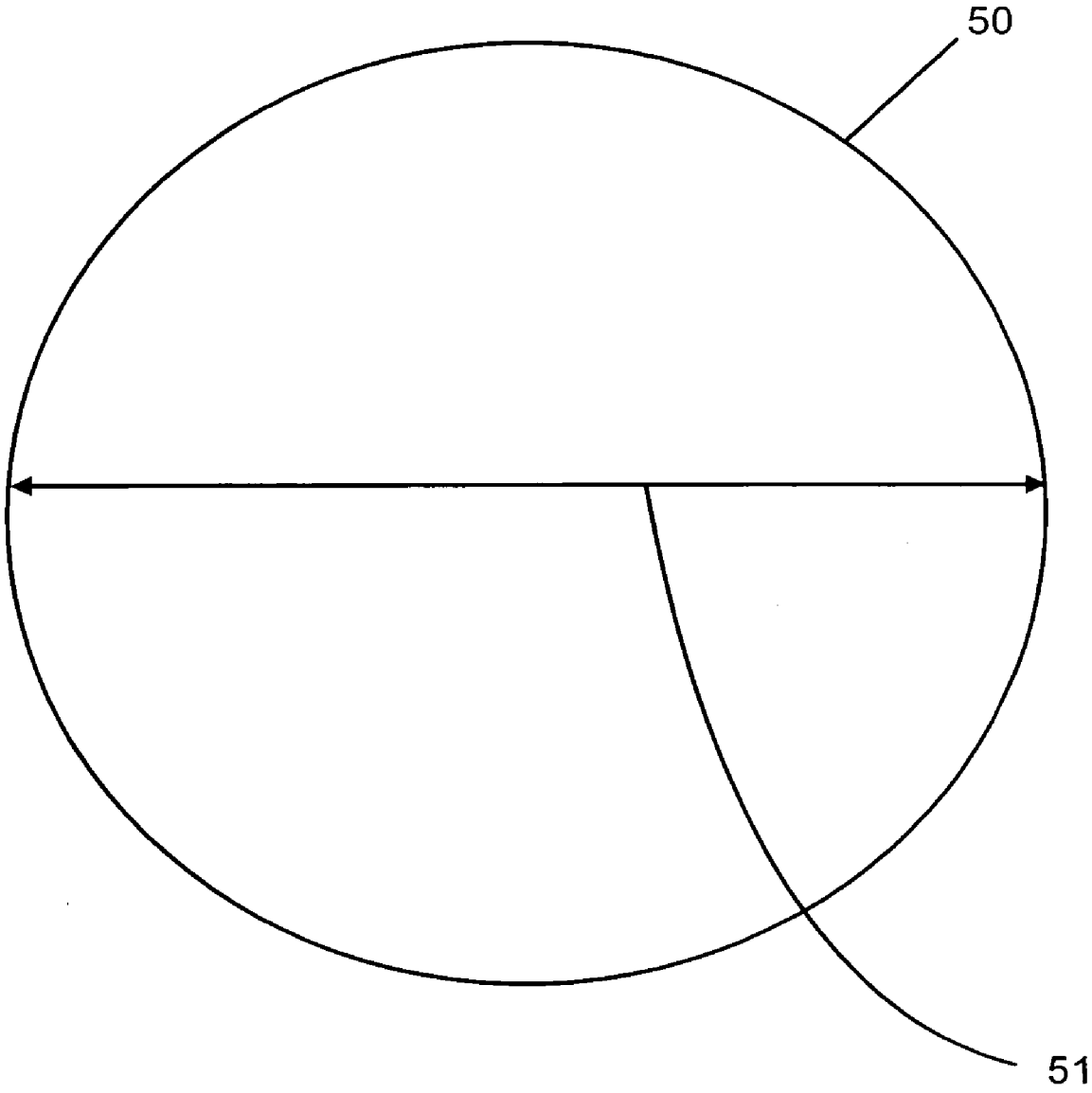
FIGS. 3 and 4 show a cross-sectional comparison of the discharge duct of the ventilator used in this invention and the discharge duct of a conventional furnace blower.
Figure 4:
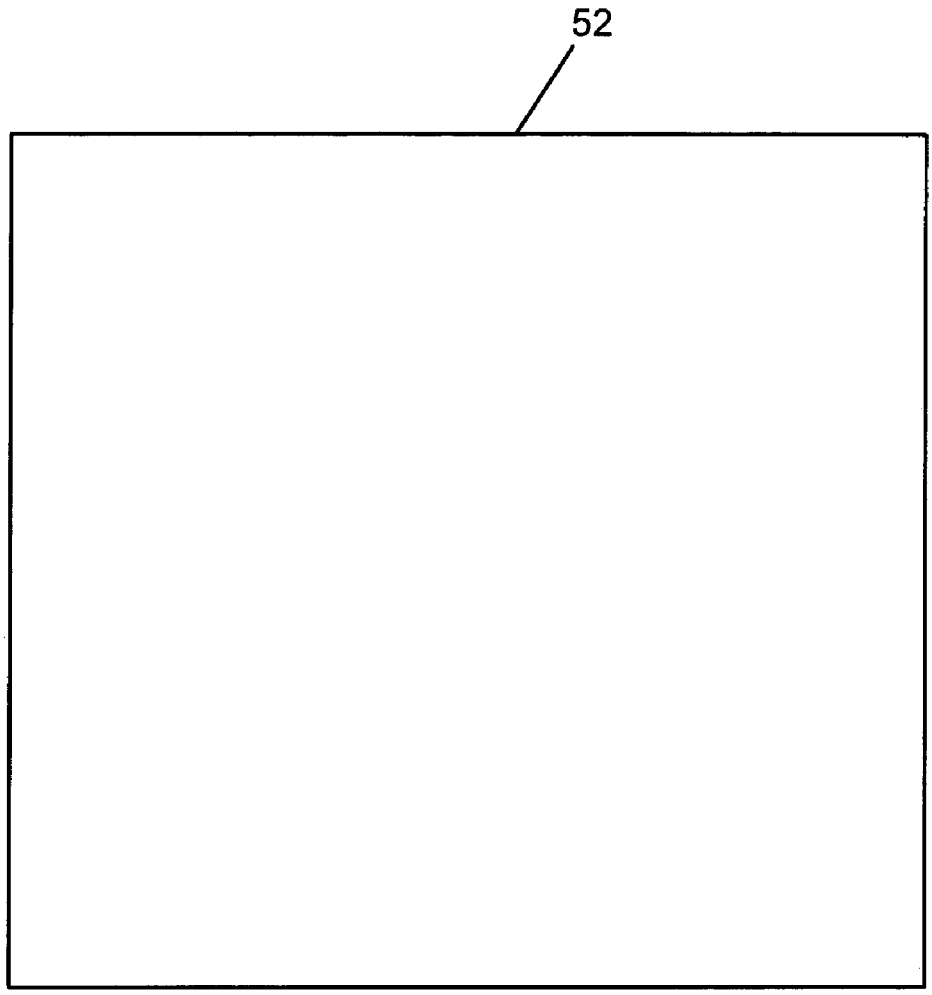

FIGS. 3 and 4 demonstrate a comparison between the relative sizes of ventilator 50 and blower 16. Referring to FIGS. 3 and 4, ventilator 50 is normally round in configuration, and its air outlet diameter 51 (as well as the diameter of its discharge duct 43) is about 25 inches. This is an outlet cross-sectional area of 490 square inches. In comparison air outlet 52 of blower 16 is a square or rectangle having an outlet cross-sectional area of 2,052 square inches. Ventilator 50 transports no more than about 66% of the air volume of blower 16. Ventilator 50 weighs only about 275 pounds, while blower 16 weighs in the thousands of pounds. Ventilator 50 moves air at the rate of from about 10,000 to no more than about 20,000 standard cubic feet per minute (SCFM) whereas blower 16 blows air at the rate of at least 30,000 SCFM.

Various commercially available ventilators can be employed in this invention. One type proved in actual practice was manufactured by Coppus Portable Ventilation Division of Tuthill Corp., Millbury Mass., Model RF-24.

It was originally thought that a small ventilator would not work in keeping furnace 1 operating at an acceptable level. However, it was found that when ventilator 50 was operated in conjunction with an open drop door 40 in the configuration shown in FIG. 2, the furnace could be kept at acceptable operating efficiency even when blower 16 was completely shutdown.

Thus, in normal operation ventilator 50 is not operated and access by ambient air 46 to duct 43 is prevented by closing removable plate 54 thereby closing off ventilator 50 and duct 43 from access to ambient air 46. Close-off plate 54 can be operated automatically or manually.

In accordance with this invention, when blower 16 loses power, drop door 40 is opened, plate 54 is opened, and ventilator 50 is started into operation. When ventilator 50 is started up with drop door 40 already open, forced draft ventilator 50 and natural draft opening 41 are in operation at the same time, both moving ambient air into duct 15.

Blower 16 is normally powered by an electric motor or steam turbine. In accordance with this invention, ventilator 50 is not powered in the same way as blower 16. If ventilator 50 is powered by electricity, it must have a different electrical source from blower 16 so it can operate even if the electrical supply to blower 16 is stopped. If the power source for blower 16 is a steam turbine, then electrical power for ventilator 50 is acceptable. Preferably, ventilator 50 is pneumatic powered so as to be completely independent of the power supply for blower 16. The pneumatic power source can be plant compressed air that is available throughout most plants. Because of its small air handling capacity, ventilator 50 can readily be made to operate on standard plant air pressure of from about 50 to 90 psig to move from about 12,000 to about 17,000 SCFM of air. Pressurized nitrogen or other inner gasses can also be employed. If desired, more than one ventilator 50 can be employed on duct 15 on its top, side(s), or bottom.

A conventional air flow meter can be installed downstream of ventilator 50 and duct 43, but upstream of plenum 14, to measure the air flow reaching plenum 14, whether this air flow is from ventilator 50 alone, blower 16 alone, a combination thereof if blower 16 is not shut down but just operating at a significantly reduced air moving capacity, or a combination of ventilator 50 and open door 40 if blower 16 is completely shut down. Various commercially available flow meters can be employed such as those supplied by Air Monitor Corporation of Santa Rosa, Calif.

From the foregoing description, one skilled in the art will readily see numerous advantages for the use of this invention. For example, in the start-up mode most furnaces employ a burner management system (BMS). These systems normally require purging the heater section 5 of FIG. 1 with air at 5 times the volume of the heater section 5 before natural gas flow is started. If blower 16 is not operating and heating section 5 is cold, it would be very difficult to conduct an air purge to the extent required by the BMS. This invention can be used to advantage in this example by opening door 40 to take advantage of the natural draft of the furnace stack 12, and operating ventilator 50 to augment the natural draft. Flow meter 55 will indicate when the BMS is satisfied.

Another example would be in respect of the normal operation mode. This invention keeps the burners, and, therefore the plant, operating even if blower 16 stops operation altogether. This helps maximize plant output and at the same time minimize safety concerns associated with having to restart a shutdown, cold furnace. For example, if blower 16 should shutdown altogether, with this invention door 40 would be opened, natural gas fuel flow would be cut back but not stopped entirely as would be the case if no ventilator 50 was available. With continued natural gas flow, the furnace burners are kept in operation and the furnace stays warm while ventilator 50 is started up. Thereafter, natural gas flow is increased to as close to normal as possible with drop door 40 open for natural draft and ventilator 50 operating for augmenting forced draft. It has been found by actual operation that with this combination of apparatus and related steps aforesaid, ambient air will readily flow into plenum 14, and, contrary to some expectations, will not escape through opening 41. This procedure has been used in actual practice and has demonstrated that heating section 5 can be kept operating in a manner that brought furnace 1 back to a production capacity of at least 66% of what it had been before blower 16 ceased operation.

In the emergency mode this invention allows for rapid restart of furnace 1 before it cools down to a large extent. For example, a stoppage of natural gas flow to burners 22 and 23 can sometimes cause a mechanical malfunction of blower 16. In such an event, by this invention, door 40 would be opened and ventilator 50 started up so that the burners can be restarted immediately upon reestablishment of gas flow to the burners even though blower 16 may not yet be operable again. This example demonstrates an advantage of this invention in providing a method and apparatus for restarting a furnace before the furnace cools off unduly due to a fuel supply interruption.

Reasonable variation and modification can be made within the scope of this invention without departing from the scope and spirit of this invention.

We claimed:

1. In a fuel fired furnace having a heating section containing at least one burner for firing said furnace and an air plenum for admitting combustion air to said at least one burner, said furnace having a blower for forcing combustion air into an air duct which is operably connected between said blower and said plenum, said blower having a first power source, said duct having a long axis extending from said blower to said plenum, said duct having a normally closed drop door that can be opened to admit ambient air into said duct, the improvement comprising at least one ventilator operably connected to said duct downstream of both said blower and said drop door and upstream of said plenum to force ambient air into said duct toward said plenum, said ventilator having a second power source, said ventilator having a movable close-off plate that is normally closed but which can be opened when said ventilator is in operation to admit ambient air to said ventilator and by way of said ventilator to said duct, said second power source being different from said first power source so that said ventilator is capable of operation independent of said blower and said first power source.

2. The apparatus of claim 1 wherein said ventilator is angled with respect to said long axis of said duct so as to force air entering said duct from said ventilator in the direction of said plenum and away from said drop door.

3. The apparatus of claim 1 wherein said ventilator has an air flow capacity of less no more than 66% of the air flow capacity of said blower.

4. The apparatus of claim 1 wherein an air flow meter is carried in said duct between said ventilator and said plenum.

5. The apparatus of claim 1 wherein said blower is one of electrically or steam turbine powered, and said ventilator is capable of operation when said blower is inoperable.

6. The apparatus of claim 5 wherein said ventilator is pneumatically powered.

7. A method for continuing the operation of a fuel fired furnace having a heating section containing a plenum for feeding air to at least one burner, and having a blower operated by a first power source for forcing combustion air through a duct into said plenum said duct having a normally closed drop door which when open admits ambient air into said duct, the improvement comprising providing a normally closed ventilator in operable communication with said duct downstream of said drop door, said ventilator being normally not in operation, said ventilator when in operation being powered by a second power source that is independent of said first power source, when said blower operation is reduced opening said drop door, and opening and operating said ventilator thereby to maintain at least partial air flow in said duct to said plenum notwithstanding the reduced operation of said blower.

8. The method of claim 7 wherein said blower operation is completely stopped.

9. The method of claim 7 wherein said ventilator when in operation has an air flow capacity of no more than 66% of said blower.

10. The method of claim 7 wherein said ventilator is oriented with respect to said duct so as to force air in the direction of said plenum.

11. The method of claim 7 wherein said blower is powered by one of an electric motor and a steam turbine, and said ventilator is pneumatically powered.

* * * * *